US006716122B2

(12) United States Patent
Vermeulen

(10) Patent No.: US 6,716,122 B2
(45) Date of Patent: Apr. 6, 2004

(54) COLLAPSIBLE SPORTS GOAL

(75) Inventor: Etienne P. Vermeulen, Amsterdam (NL)

(73) Assignee: Fast! Products, Amsterdam (NL)

( * ) Notice: Subject to any disclaimer, the term of this patent is extended or adjusted under 35 U.S.C. 154(b) by 0 days.

(21) Appl. No.: 10/080,955

(22) Filed: Feb. 22, 2002

(65) Prior Publication Data

US 2002/0119842 A1 Aug. 29, 2002

(30) Foreign Application Priority Data

Jan. 31, 2002 (NL) ..... 1019878

(51) Int. Cl.[7] ..... A63B 63/00
(52) U.S. Cl. ..... 473/476; 273/400
(58) Field of Search ..... 473/476, 197, 473/168, 169, 170, 172, 195, 196, 478; 273/398, 399, 400, 401, 402

(56) References Cited

U.S. PATENT DOCUMENTS

| | | | | |
|---|---|---|---|---|
| 5,244,213 A | | 9/1993 | Armell | |
| 5,433,433 A | | 7/1995 | Armell | |
| D368,290 S | | 3/1996 | Lobos et al. | |
| 5,496,040 A | | 3/1996 | Amburgey et al. | |
| 5,533,733 A | | 7/1996 | Dirnbeck | |
| 5,566,952 A | | 10/1996 | Mullin et al. | |
| 5,580,064 A | | 12/1996 | Childers, Jr. | |
| 5,651,551 A | | 7/1997 | Ferrara et al. | |
| D384,382 S | * | 9/1997 | Armell | D21/705 |
| 5,665,693 A | | 9/1997 | Kroner et al. | |
| 5,681,231 A | | 10/1997 | Reeves | |
| 5,823,885 A | * | 10/1998 | Stempfer | 473/197 |
| 5,830,089 A | | 11/1998 | Pavonetti | |
| 5,842,939 A | | 12/1998 | Pui et al. | |
| 5,857,928 A | | 1/1999 | Stewart | |
| 5,902,195 A | | 5/1999 | Pavonetti | |
| 5,941,529 A | * | 8/1999 | Kinsey | 273/401 |
| 5,951,415 A | | 9/1999 | Gates et al. | |
| 6,165,085 A | | 12/2000 | Lubin | |
| 6,530,844 B2 | * | 3/2003 | Lin | 473/197 |

* cited by examiner

*Primary Examiner*—Stephen Blau
*Assistant Examiner*—M. Chambers
(74) *Attorney, Agent, or Firm*—Banner & Witcoff

(57) ABSTRACT

The invention relates to a collapsible sports goal. The goal consists of a triangular base-frame made from textile straps with corner-pieces that make contact with the ground surface. A bent pole and a straight pole are fitted in the corner pieces. The bent pole and the straight pole are connected in the middle of the bent pole. The set of poles holds a net that is fixed to the bent pole via the means of a sleeve and drapes over the straight pole. The structure may be anchored to the ground surface with pegs.

14 Claims, 2 Drawing Sheets

COLLAPSIBLE SPORTS GOAL

The invention strives to be a simple but effective sports goal that is easy to set up, lightweight, easy to carry that can me solidly anchored to the ground.

The invention relates to a collapsible sports goal. The goal consists of a triangular base-frame made from textile straps with corner-pieces that make contact with the ground surface. A bent pole and a straight pole are fitted in the corner-pieces. The corner-pieces contain 2 holes, one to fit the poles and one to fit the pegs to anchor the structure in the ground. The bent pole and the straight pole are connected in the middle of the bent pole. The set of poles holds a net that is fixed to the bent pole via the means of a sleeve and drapes over the straight pole. The structure is entirely collapsible and can be taken apart completely; as such it is very easy to set up and take apart.

A likewise shaped goal is known under U.S. Pat. No. 5,244,213. This goal has a spring contraption that makes the construction a lot more complicated and less portable. The straight back-pole used in the invention presented in this application is connected to the bent pole in the middle of this bent pole and as such makes the structure less complicated and easier to set up and carry. Also the use of peg holes and pegs for anchoring renders the invention immobile when constructed.

Under U.S. Pat. Nos. 5,433,433 and D384,382 similarly shaped goals are presented. These goal have a wire constructions that function as the frameworks of the goals. At first glance the goals seem similar to the presented invention, but the capability to collapse fully, the use of a straight back pole connecting to the bent pole and the use of a triangularly shaped textile frame make the presented invention a completely different one. Only the arched front and the use of a net are similar.

U.S. Pat. No. 5,496,040 shows a foldable goal. This goal is easy to set up and easy to carry. The use of completely different materials and the different shape and system of collapsibility make this goal to be a completely different one than the presented invention. Both goals are portable and foldable, but use different ways of achieving portability and collapsibility.

Another portable goal can be found under U.S. Pat. No. 5,533,733. This goal uses a similar back pole structure to add strength to the design. The use of a triangular shaped textile frame and the use of a bent pole that is connected to the straight back pole make the presented invention of a significantly different design.

Other portable goals can be found under U.S. Pat. Nos. 5,681,231, 5,842,939, 5,857,928, 5,566,952, 5,580,064, 5,665,693, 6,165,085, 5,951,415, 5,902,195, 5,857,928, 5,830,089, 5,651,551, and Des. 368,290. These goals all claim to be portable sports goals, but the capability to collapse fully, the use of a straight back pole connecting to the bent pole and the use of a triangularly shaped textile frame make the presented invention significantly different from said goals.

The invention is reviewed using the following drawings.

Figure 1:
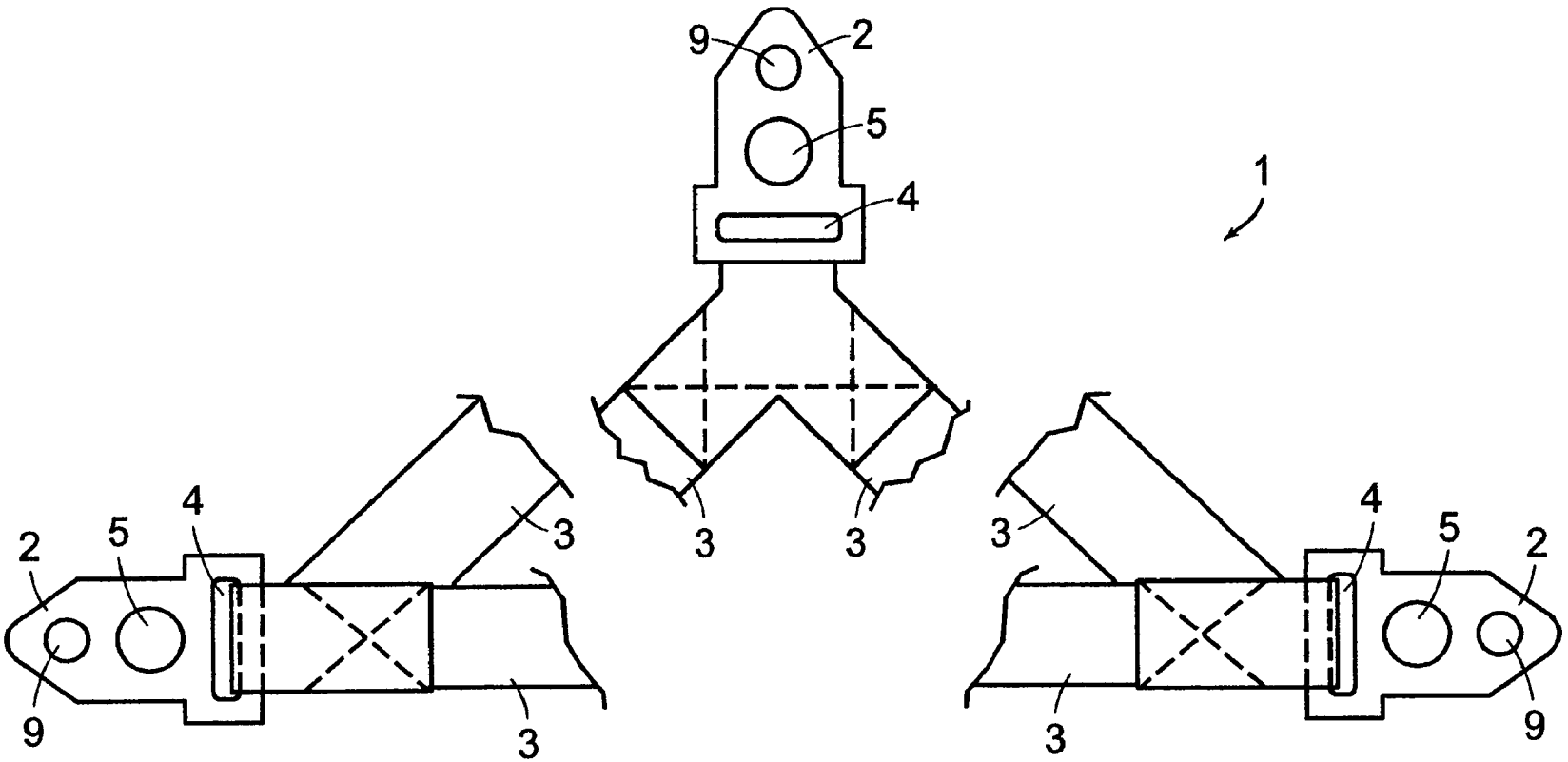
FIG. 1 shows the triangular base-frame
Figure 2:
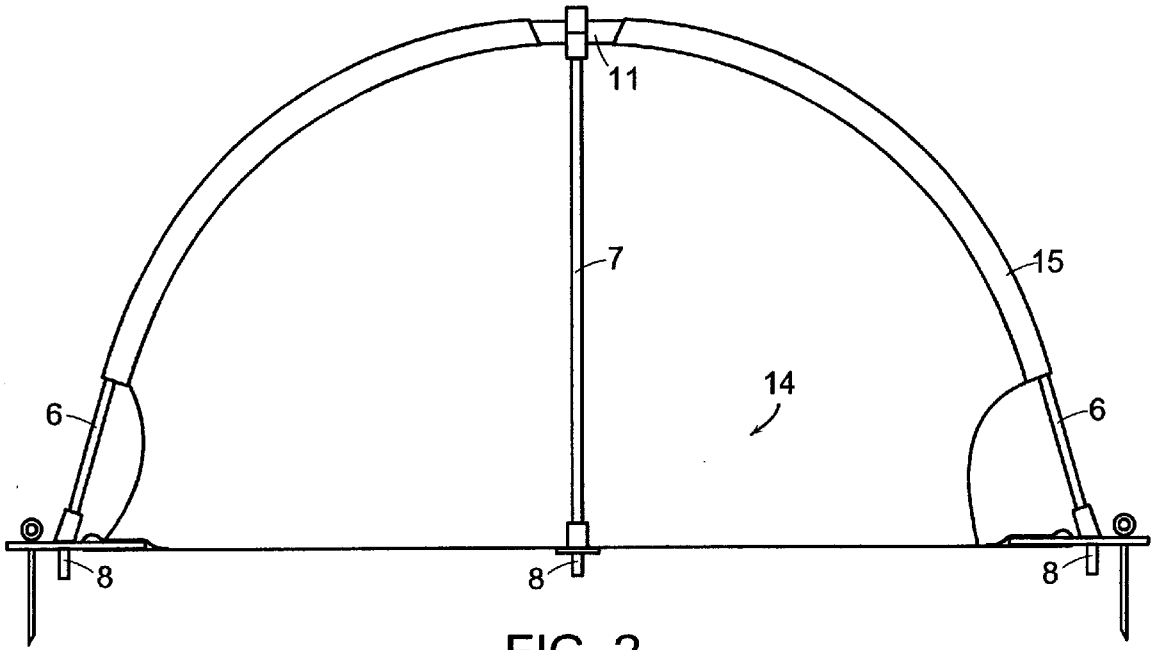
FIG. 2 shows the front view of the goal
Figure 5:
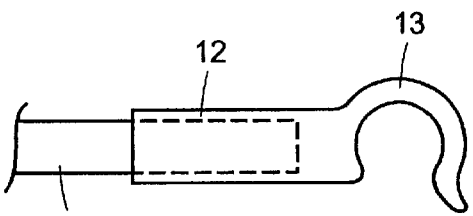
FIG. 5 shows the connection piece of the straight pole (that which connects the straight pole with the bent pole)
Figure 4:
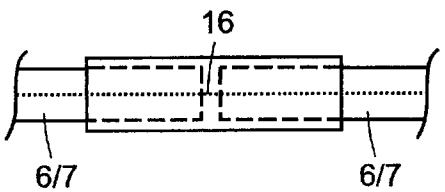
FIG. 4 shows the coupling of the parts of the poles
Figure 3:
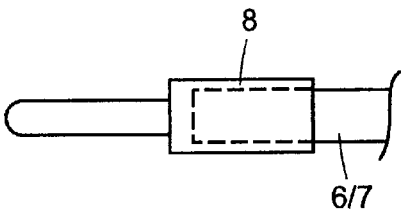
FIG. 3 shows the ends of the poles that are fitted in the corner-pieces

The triangular base-frame (1) shown in FIG. 1 consists of corner-pieces (2) which are connected through textile straps (3) using rectangular holes to connect the textile straps (3) to the corner-pieces (2). The corner-pieces (2) have holes (5) to fit the ends (8) of the bent pole (6) and the end (8) of the straight pole (7). The corner-pieces (2) have additional holes (9) to fit pegs (10) to anchor the structure to the surface.

In the middle of the bent pole (6) a cover (11) is used as coupling between the parts of the pole and also facilitates the connection of the straight pole (7) and the connection piece on this pole (12). The connection piece (12) on the straight pole (7) is fitted with a hook-like clamp (13) that clicks onto the cover (11) in the middle of the bent pole (6). The net (14) is fixed to the bent pole (6) through a sleeve (15) and drapes over the straight pole (7).

The poles (6+7) are separable at the covers (11) and are joined by elastic wire (16) running trough the poles.

The bent pole (6) and the straight pole (7) are preferably made from fibreglass with metal or synthetic covers (11). The corner-pieces (2) can be made of plastic (synthetics) or metal (aluminium). The connection piece on the straight pole (12) and its hook-like clamp (13) can be made from synthetics or a metal.

A kit for assembling an arched sports goal is provided. The kit comprises a net, a bendable front pole, a back pole, the front and back poles being cooperatively operative to support the net, and a triangular base-frame comprising straps with corner-pieces, each of the corner pieces being operative to receive a corresponding end of the front pole or the back pole and having holes to receive pegs for anchoring the sports goal.

What is claimed is:

1. A collapsible, arched sports goal comprising a triangular base-frame comprising textile straps with corner-pieces receiving the bent pole and the straight back pole, where the bent pole and the straight back pole support a net, and where the corner-pieces have holes to fit pegs for anchoring purposes.

2. A collapsible sports goal according to claim 1 further comprising a cover in the middle of the bent pole, the cover facilitating the connection of the straight back pole using a connection piece and a hook-like clamp.

3. A collapsible sports goal according to claim 1 wherein the bent pole and the straight back pole are made from fibreglass and the corner-pieces are made from metal or plastic.

4. A collapsible sports goal according to claim 2 wherein the bent pole and the straight back pole are made from fibreglass and the corner-pieces are made from metal or plastic.

5. A collapsible sports goal according to claim 1 wherein the bent pole and the straight back pole comprise fibreglass parts, connected through covers and joined together by elastic wire running through the poles.

6. A collapsible, arched sports goal comprising:

a bent pole;

a back pole;

a triangular base-frame comprising textile straps with corner-pieces, each of the corner pieces receiving a corresponding end of the bent pole or the back pole; and a net supported by the bent pole and the back pole;

wherein the corner-pieces have holes to receive pegs for anchoring the goal.

7. A kit for assembling an arched sports goal, comprising:

a net;

a bendable front pole;

a back pole, the front and back poles being cooperatively operative to support the net; and a triangular base-frame comprising straps with corner-pieces, each of the corner pieces being operative to receive a corresponding end of the front pole or the back pole and having holes to receive pegs for anchoring the sports goal.

8. A collapsible sports goal comprising:

a bent pole comprising a first end, a second end, and a cover;

a back pole comprising a first end and a second end, the first end comprising a hook-like clamp attached to the bent pole;

first, second and third corner pieces each comprising a slot for receiving a textile strap, the first corner piece comprising a first hole receiving the first end of the bent pole and a second hole for receiving a peg, the second corner piece comprising a first hole receiving the second end of the bent pole and a second hole for receiving a peg, the third corner piece comprising a first hole receiving the second end of the back pole and a second hole for receiving a peg;

a net supported by the bent pole and the back pole and fixed to the bent pole.

9. The collapsible sport goal of claim 8 further comprising at least one textile strap received by the slots of the corner pieces.

10. The collapsible sports goal of claim 8 further comprising a sleeve receiving the bent pole and attached to the net.

11. A kit for assembling a sports goal, the kit comprising:

a net;

a bendable front pole;

a back pole; and at least three corner pieces, in which each of the corner pieces comprises a first hole for receiving a corresponding end of the front pole or the back pole, a second hole for receiving a peg, and a slot for receiving a textile strap.

12. The kit of claim 11 further comprising a plurality of pegs for insertion into the second hole of corresponding ones of the corner pieces.

13. The kit of claim 12 further comprising at least one textile strap for strapping the corner pieces to each other as a base frame.

14. The kit of claim 11 wherein the net comprises a sleeve for receiving the bendable front pole.

* * * * *